US005709466A

United States Patent [19]

Weszely

[11] Patent Number: 5,709,466

[45] Date of Patent: Jan. 20, 1998

[54] MIXER FOR CEMENTITIOUS MATERIALS

[75] Inventor: Ronald R. Weszely, Hebron, Ind.

[73] Assignee: Applied Innovations, Inc., Palos Park, Ill.

[21] Appl. No.: 600,264

[22] Filed: Feb. 12, 1996

[51] Int. Cl.[6] ..... B28C 7/04

[52] U.S. Cl. ..... 366/30; 588/252

[58] Field of Search ..... 366/30, 33, 34, 366/35, 37, 40, 42, 49, 50, 27; 588/252, 257, 901

[56] References Cited

U.S. PATENT DOCUMENTS

| | | | |
|---|---|---|---|
| 3,456,925 | 7/1969 | Gallagher | 366/49 |
| 3,917,236 | 11/1975 | Hanson | 366/49 |
| 4,245,915 | 1/1981 | Bracegirdle | 366/40 |
| 4,922,463 | 5/1990 | Zotto | 366/34 |
| 5,171,121 | 12/1992 | Smith et al. | 366/33 |
| 5,482,528 | 1/1996 | Angell et al. | 588/257 |
| 5,484,533 | 1/1996 | Crawford et al. | 588/252 |

*Primary Examiner*—Robert W. Jenkins
*Attorney, Agent, or Firm*—Stephen W. White

[57] ABSTRACT

An improved mixer for cementitious materials is described. This mixer is mobile and carried to the desired site and comprises a series of tanks and bins for containing the material to be mixed. The device is particularly useful in mixing hazardous wastes (e.g. low level radioactive soils, for example) within cementitious material along with sealants and chemicals designed to encapsulate the hazardous wastes therein. In order to thoroughly mix, and thus contain the hazardous wastes, the residence time within the mixing means must be between 4 and 45 seconds. This residence time may be achieved by keeping the mixing means within certain parameters of angles, relative to the ground, speed of mixing and length of mixing. By carefully controlling these variables, it is possible not only to achieve thorough mixing and encapsulation of the hazardous waste and to make a mobile mixing device that is extremely useful within the metes and bounds of the invention.

7 Claims, 4 Drawing Sheets

MIXER FOR CEMENTITIOUS MATERIALS

CROSS REFERENCES TO RELATED APPLICATIONS

This application is related to my previously filed applications U.S. Ser. No. 08/222,017, filed Apr. 4, 1994 and U.S. Ser. No. 08/408,203, filed Mar. 22, 1995.

BACKGROUND OF THE INVENTION

1. Field of the Invention

This invention relates to the field of the mixing of cementitious materials and more specifically to devices that can be used to mix cementitious materials. Still more specifically, this invention relates to the field of mobile, cementitious mixing devices that are particularly useful for the mixing of specialty cements and the like. Even more specifically, this invention relates to devices that are useful in the mixing of specialty cementitious materials that can be used to entrap and hold hazardous wastes and the like.

2. Description of the Prior Art

Devices that are used to mix up cementitious materials are well-known in the prior art. Most of these prior art devices can be readily used to mix up conventionally known cement formulations and most of these prior art devices are mobile. This means that the devices can be taken to the site and used to generate the required formulation and amount of cementitious material required. These prior art devices usually comprise a series of tanks or bins, hoses, connectors, pumps and an auger for mixing mounted on a mobile system such as a truck. The various, ingredients (e.g. cement, sand, water and gravel) are placed within the tanks or bins and then metered into the auger at the most propitious or desired time. Cementitious material so made is then pumped or augured or screwed out of the mobile unit into the desired location to affect the desired results. This mobile unit is particularly efficacious in making specialty cements right at the site. The quality of the cementitious material so made can be tightly controlled by employing this mobile mixing device since the amount of each ingredient used within the mix is controlled by the mixer to exactly match the desired formulation.

The term "Mobile Concrete Mixer" (hereinafter "MCM") is a reference to a self-contained concrete mixing machine as is well known in the art. The MCM is based on the use of volumetric proportions of ingredients on a continuous basis to feed Portland Cement and aggregates to an auger mixer contained and constantly rotating in a suitable boot, for example. Usually, two, large hoppers containing coarse and fine aggregate, stone and/or sand, are fed onto a conveyor belt through very accurate proportioning gates. While these stone/sand materials are being fed onto the conveyor belt, cementitious materials are also deposited in layers on the top of these stone/sand materials. The conveyor belt then deposits these layers into the throat of the auger mixer. Water and other materials may be added at this point and the resulting components are then mixed within the auger prior to being deposited as required by the site. Production rates of typical, prior art MCM devices are from 30 to 90 cubic yards per hour on a continuing basis. MCM's are particularly useful in making and mixing both generic and specialty or "designer" cements at areas that are remote or where concrete needs to be hauled for some distance. An MCM can prepare cementitious materials of almost any "slump" and the slump can be changed by altering the flow of materials therefrom.

These prior art MCM devices require that the flow of materials be carefully controlled so as to maximize production and minimize other difficulties (e.g. the falling of mixtures backward within the auger mixer, for example). Prior art devices teach that the residence time of materials within the mixer should be minimized to 5 seconds or less in order to overcome the flow problems. The mixing device, or auger, is a shear type device and is generally 7 to 9 feet in length and held at an angle of not more than 22 degrees relative to the ground. The motor that rotates the auger is said to move at around 250 to 350 revolutions/minute. All of these variables are designed to perform the function of the prior art—that is to produce cementitious materials at a high rate of flow at remote sites, for example.

Although these prior art devices are useful in making up specialty or designer cementitious formulations, they cannot be used in the encapsulation of hazardous wastes, for example, as taught in my previous filed applications. All of the prior art mobile cement mixers fail to realize and thus capitalize on the importance of certain variables within the mixing system in order to achieve the required encapsulation and removal of hazardous waste which may be contained therein. Since the encapsulation of hazardous waste is an extremely important objective, the need to develop a method for this encapsulation and a process to insure the proper mixture of ingredients, is of the utmost importance. No successful method, process or system has here-to-for been proposed to encapsulate and hence permit disposition of hazardous wastes.

SUMMARY OF THE INVENTION

It is an object of this invention to provide an optimal, mobile mixing device for cementitious materials used to encapsulate hazardous wastes therein. It is also an object of this invention to provide such a mobile mixing device for the encapsulation of hazardous low level radioactive wastes and the like. These and yet other objects am achieved in a mobile mixing device for the preparation of cementitious materials to contain and encapsulate hazardous wastes comprising a mobile element having at least three containers, two of said containers being located over a transporting means, and said transporting means being connected to a mixing means, the first of said containers having an aqueous mixture of chemical sealants, a second of said containers having hazardous waste and a third of said containers having cementitious material therein, said first and said second containers being located over said transporting means, wherein when said hazardous waste and said cementitious material are placed on said transporting means and transported to said mixing means, and said aqueous mixture of chemical sealant are added thereto, said mixture of hazardous waste, cementitious material and said chemical sealant are caused to be held within said mixing device for a residence time of between 5 and 45 seconds prior to exit therefrom.

In yet another embodiment, said residence time of said mixture within said auguring means is accomplished by placing said auger at an angle, relative to the ground, of between 22° and 60° when said auger being operated between 350 and 800 revolutions per minute and said auger has a length of between 6 to 15 feet.

DETAILS OF THE INVENTION

Figure 1:
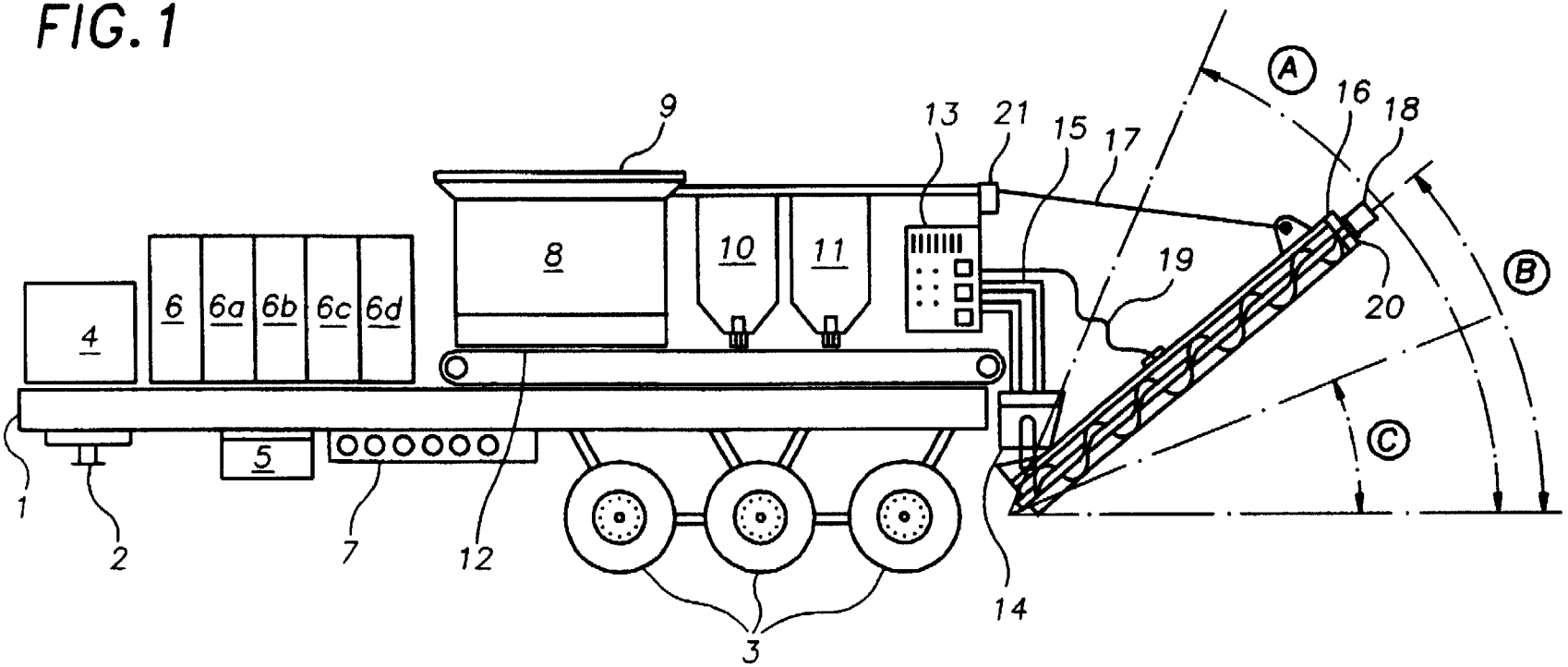
FIG. 1 is an overall side view of the mobile, cementitious mixing device of this invention wherein the auger is shown in cut-away.

Referring now specifically to the drawings, which show the operability, function and best mode of this invention, but by which this invention is not limited, FIG. 1 is an overall side view of the mobile, cementitious mixing device of this invention as it might be attached to the trailer part of a tractor trailer, for example. In this figure, the tractor part of the tractor trailer is not shown. However, the trailer is shown as 1 and the connection for adding the tractor is shown as 2 with a set of three wheels, for example, as 3. In this particular embodiment, an element moving means, shown as 4, may be a diesel engine/generator, etc., designed to pump and drive the component parts downstream on the trailer. Fuel for the driving means, may be contained in a typical fuel tank shown as 5. A series of tanks that are designed to contain all of the various ingredients that may be used to make the formulation intended to mix with the cementitious material and insure that the hazardous wastes are firmly contained therein, are shown as 6, 6*a*, 6*b*, 6*c* and 6*d*. There may be more or less of these tanks depending on the constituents necessary to perform this function. On the underside carriage there is shown as 7 a series of pumps designed to pump the fluids contained within tanks 6 et seq. in the remainder of the processing system downstream thereof. Hoses that carry the fluids from tanks 6 et seq. to a control panel, for example, are not shown. 8 is a large tank or bin which contains the hazardous waste material and may also contain additional sand, gravel or aggregate if required. Most of the hazardous wastes are found already contained in soil and the like and it may not be necessary to add other material thereto. A vibrating screen 9 is shown on top of bin 8. This screen insures that larger particles and stones are not carded into bin 8. Two other tanks or bins, 10 and 11, are shown just downstream of hazardous waste containing bin 8. Cementitious materials may be placed within bins 10 and 11. A conveyor belt 12 is shown located directly under bins 8, 10 and 11. A control panel is shown at 13. This element is designed to control the addition of hazardous waste and cements from bins 8, 10 and 11 as well as the flow of fluids from tanks 6 et seq. As the conveyor belt 12 moves hazardous waste (which may contain aggregate) and cementitious material from bins 8, 10 and 11, these materials fall into tray or boot 14. A series of lines 15 then pump in the various ingredients from tanks 6 et seq. This particular mixture then falls into a auger or other mixing device shown as 16. This auger is held at a particular angle relative to the ground by line 17, controlled by motor 21, whilst the auger is driven by motor 18. The angles are shown by dashed lines as A, B and C. Additional chemicals and other liquids contained in tanks 6 et seq. may also be added to the auger mixture through another line 19. Completely mixed hazardous waste material, mixed thoroughly with chemicals, liquids and cementitious material, then flows out of auger 16 at the end 20 near auger motor 18. It is this completely mixed, chemical containing, cementitious material that will, when hardened, safely contain the hazardous waste suitable for disposal (e.g. in a landfill, for example).

Figure 2:
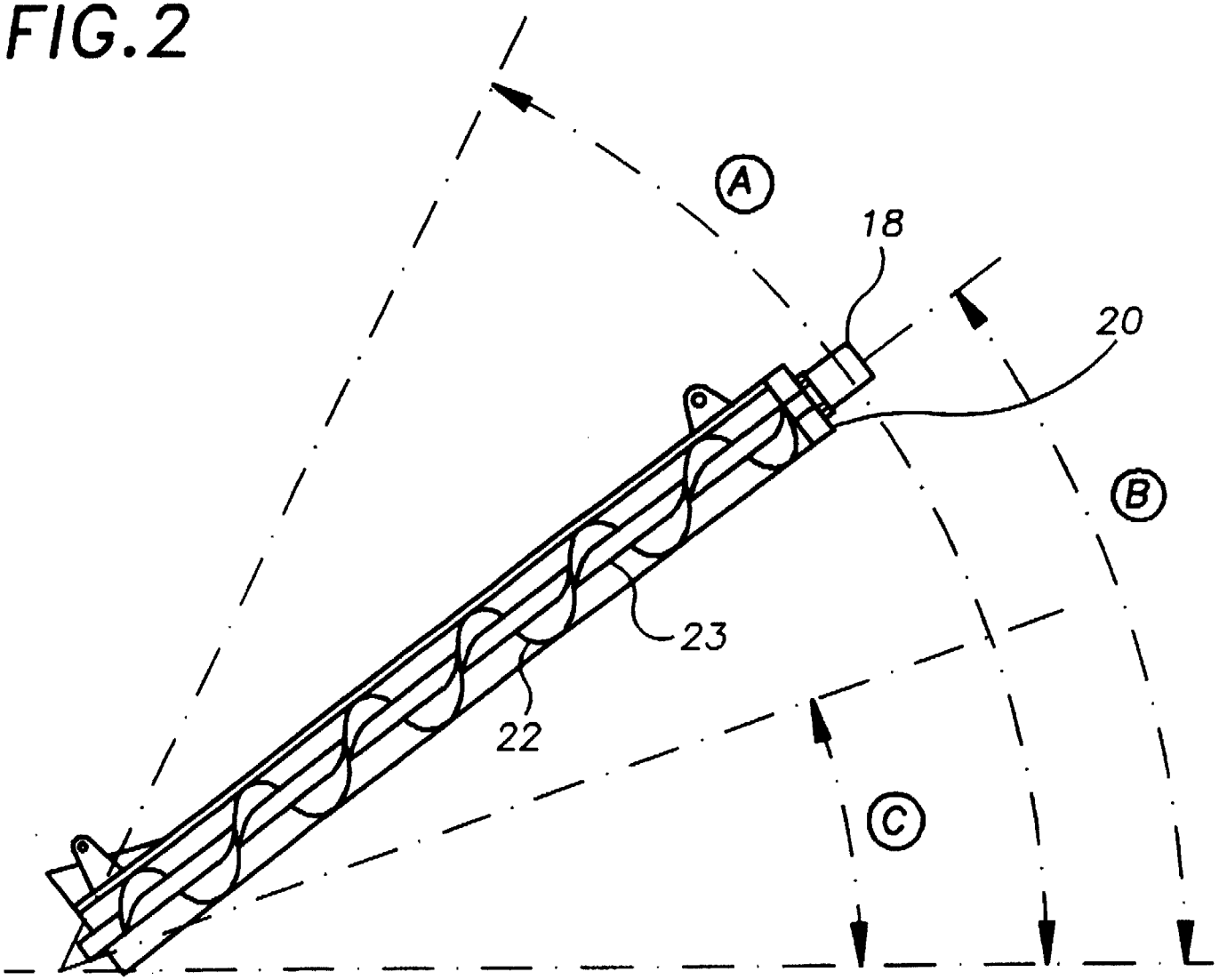
FIG. 2 a detailed side view showing of the auger from FIG. 1.

FIG. 2 is a detailed, side view showing of the auger from FIG. 1. In this showing (slightly enlarged) as in FIG. 1, the auger is shown in cut-away form so as to show the auger itself. In this showing, the auger itself is 16, the motor to drive the auger is 18 and the angles relative to the ground level are A, B and C. The auguring mechanism is a serpentine device 22 that is contained on a central axis 23. As motor 18 turns the central axis 23 any material contained within the body of the auger is moved and concurrently thoroughly mixed and then is deposited out end 20. There may be other elements at end 28 to transfer the mixed materials into a pit or container but these are not shown in these figures.

Figure 3:
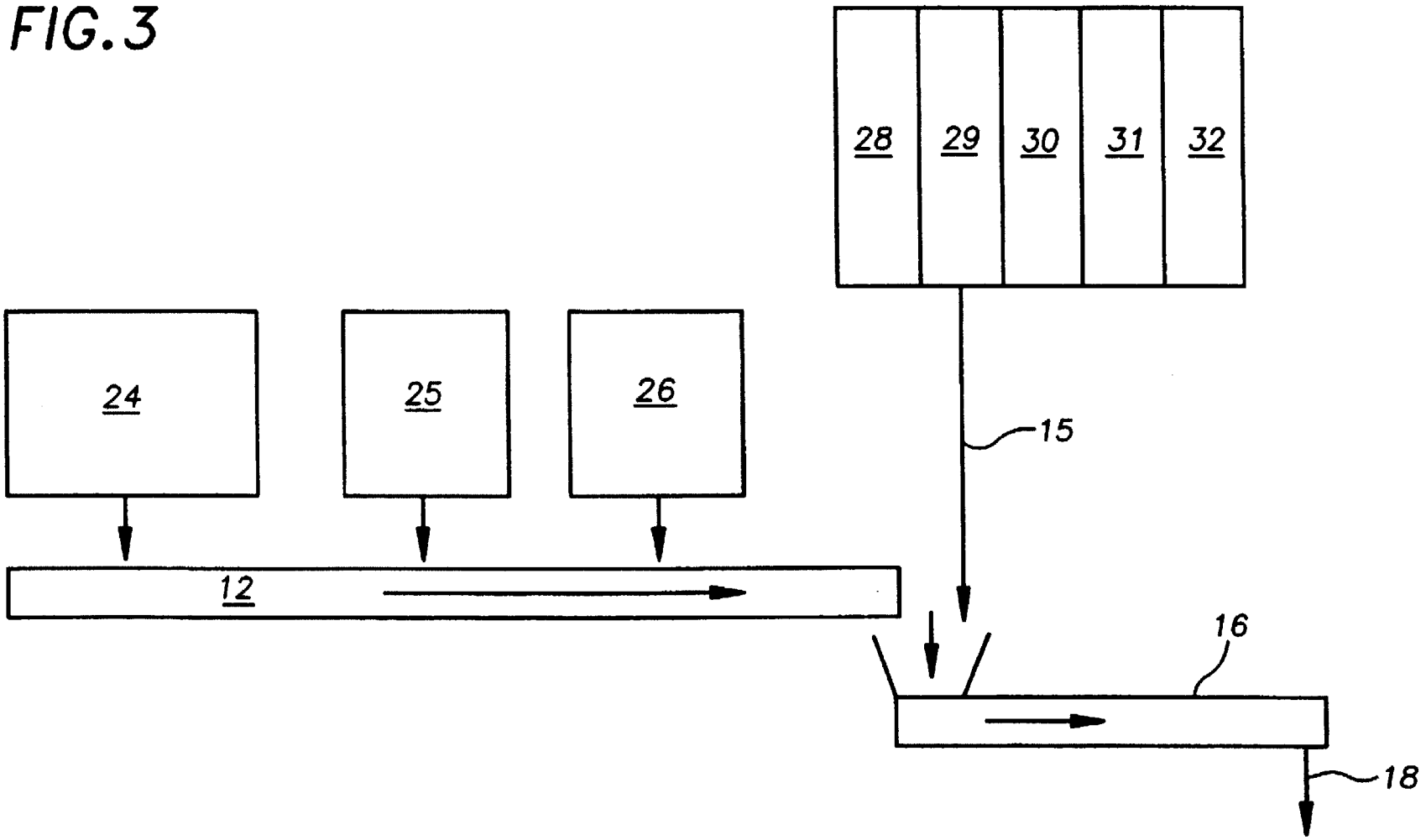
FIG. 3 is a block diagram showing the process achieved by using the cementitious mixing device of this invention.

FIG. 3 is a block diagram of the process of this invention and shows in detail all of the ingredients required within the ambit of this invention to function within the cementitious mixer described herein. This drawing is meant to show the mobile mixing device of this invention in its' most simple format. Within this figure, 24 may contain the hazardous waste materials (e.g. low-level radioactive soil wastes, for example), 25 and 26 may contain cementitious materials, compartments 28 et seq. may contain water and other components requisite to the encapsulation of hazardous wastes within the cementitious materials, as taught in my previously filed patent applications. All of these ingredients will flow by transportation means represented by 12 or by a series of flow lines represented by 15 into the requisite mixing means 16 (e.g. an auger, for example) and the resulting mixture then flows out at a point represented by 18.

Figure 4:
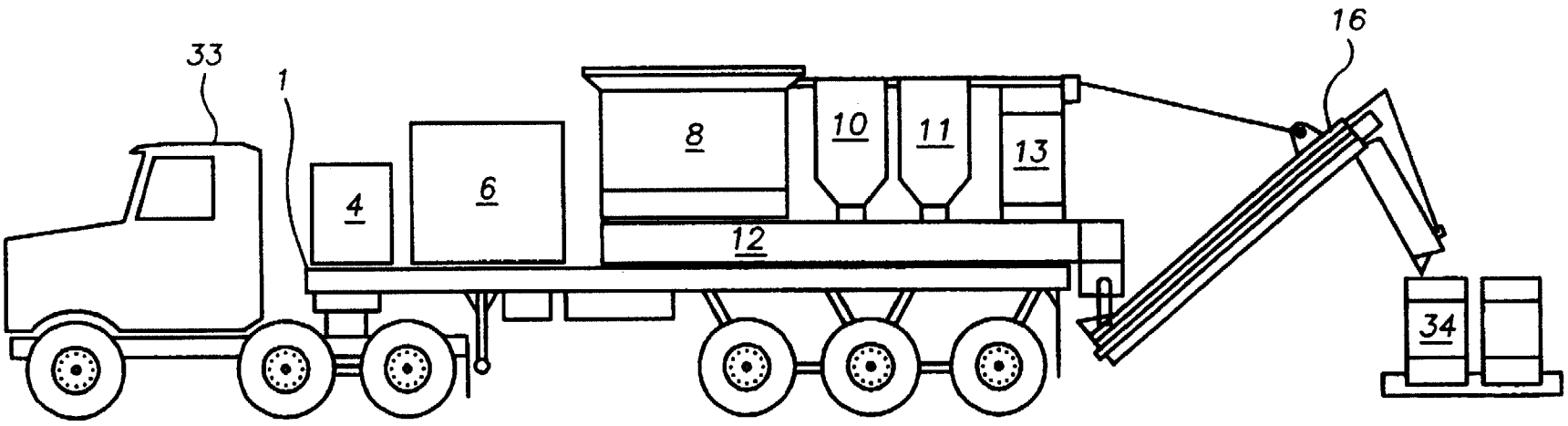
FIG. 4 is an overall view of the trailer of FIG. 1 connected to a transporting means. This FIG. generally shows the entire mobile device of this invention.

FIG. 4 is an overall showing of the entire vehicle representing the mobile mixing device of this invention. In this figure, 33 is the motorized cab that can be used to move trailer 1. The areas marked as 4, 6, 8, 10, 11, 12, 13, and 16 are as previously described in FIG. 1, but are shown in much less detail. In this particular figure, the hazardous waste material, which has already been thoroughly mixed within the cementitious material along with the various ingredients necessary to encapsulate same, are shown being passed out the end of the auger 16 and into a drum 34 in order to be later removed and disposed of safely. All of the other items shown on the motorized vehicle are simply prior art components of any motorized vehicle and are not particularly germane to the essence of this invention which lies within the mixing elements and the time frame or residence time requisite to insuring a complete encapsulation of the hazardous waste within the cementitious material.

One of the most important details of this invention is the residence time required to mix the ingredients necessary to completely and safely contain the hazardous wastes within the cementitious material (e.g. between 5 and 45 seconds). This residence time may be achieved by increasing the length of the auger or other mixing device contained within the mobile mixer. Although the residence time may be achieved by varying the length of the mixing device (e.g. auger) and the speed at which the mixing device is turned, both of these variables have limited value since they tend to add other problems when they are changed greatly. For example, if the length of the mixing device is increased too much, it becomes very inconvenient to use and expensive to manufacture and operate. Again, if the speed at which the mixing device is lowered to increase the residence time, the ingredients are not thoroughly mixed in order to achieve the desired results. Finally, by increasing the angle at which the mixing device is held relative to the ground can also increase the residence time of the materials contained therein. However, increasing this angle too much can result in "fall-back" of the materials as they are being mixed and this results in incomplete mixing, for example.

Within the drawings described above, there are a variety of angles shown as A, B and C. Angle A is the maximum angle at which the device of this invention may operate and still achieve the desired mixing results. This angle is 60 degrees. Angle C is the minimum angle at which the device of this invention may operated and still achieve the desired mixing results. This angle is 22 degrees. Angle B is shown at a most preferred or optimum angle of 35 to 37 degrees.

Thus, by controlling the variables of mixer length (6 to 15 feet for a typical auger type mixer), mixer rotation speed (350 to 800 rpm for a typical auger type mixer) and angle of the mixer relative to the ground (22 to 60 degrees relative to the ground, for a typical auger type mixer), it is possible to mix all of the relating ingredients with the hazardous waste and achieve the desired result of the encapsulation thereof within the cementitious material.

A variety of mixing devices may be used within the ambit of this invention and still achieve the desired mixing results. Typical of these mixing devices are the screw-type and auger-type mixers and these are conventional and well known in the art. However, other mixing devices that propel the ingredients along a central axis as they are being concurrently mixed together, are also known and may be used within the metes and bounds of my invention. These devices may be contained in trays or half-drums or may also be contained within a tube-like element and serve to mix and transport at the same time.

The mixing elements of my invention may be contained, as shown, in a tractor-trailer device or in some other motorized yet convenient device (e.g. larger truck, for example). Since my device fits within the MCM description above, any of the prior art motorized devices may also be used to transport the device of this invention equally as well.

Within the drawings, the hazardous waste and cementitious materials are shown moved along with a typical conveyor belt. However, any continuous device can be used to move these materials to the tray or boot which is connected to the mixing device.

In a particularly preferred embodiment or mode of this invention, the device is as shown in FIG. 1 and the tanks at the beginning of the trailer will contain water in tank 6, a silicate solution in tank **6*a*, a gelling agent in tank 6*b*, a plasticizer in tank 6*c* and some water proofing agent in tank 6*d*. Hazardous waste (e.g. low level radioactive soil) is screened to remove larger elements (e.g. large rocks, etc.) through screen 9 and is then contained in bin 8. This material fed by a proportioning gate, for example (not shown) on to a conveyor belt 12. Simultaneously, cementitious material contained within bins 10 and 11 are also fed through proportioning gates (not shown) on top of the hazardous waste already on the conveyor belt 12. This material then falls into tray or boot 14 where the liquids from tanks 6 et seq. are also fed. From boot 14 the mixture of chemicals, water, hazardous waste and cementitious material is then fed into a mixing device shown as auger 16. This auger is held at an angle relative to the ground of 35 to 37 degrees (particularly preferred) by adjusting line 17 with motor 21. At this particular angle, the materials are thoroughly mixed with a residence time in the mixing device of from 5 to 45 seconds. The mixed material, exits out of the mixing device at end 20** and is then suitable for safe disposal since the hazardous waste will be safely contained and encapsulated within the cementitious materials.

In yet another embodiment, the mixer of this invention may be contained within a tube-like container of between 4 and 18 inches in diameter. The addition of other elements along the boot and tube of the mixing device may be added to enhance the mixing itself.

I claim:

1. A mobile mixing device for the preparation of cementitious materials to contain and encapsulate hazardous wastes comprising a mobile element having at least three containers, two of said containers being located over a transporting means, and said transporting means being connected to a mixing means, the first of said containers having an aqueous mixture of chemical sealants, a second of said containers having hazardous waste and a third of said containers having cementitious material therein, said first and said second containers being located over said transporting means, wherein when said hazardous waste and said cementitious material are placed on said transporting means and transported to said mixing means, and said aqueous mixture of chemical sealant are added thereto, said mixture of hazardous waste, cementitious material and said chemical sealant are caused to be held within said mixing device for a residence time of between 5 and 45 seconds prior to exit therefrom.

2. The mobile mixing device of claim 1 wherein said mixing device is an auguring device.

3. The mobile mixing device of claim 2 wherein said auger is held at an angle, relative to the ground of between 22 and 60 degrees.

4. The mobile mixing device of claim 3 wherein said auger is rotated by a motor device at a speed of between 350 and 800 revolutions per minute.

5. The mobile mixing device of claim 4 wherein said auger is contained within a tube and said tube is between 4 and 18 inches in diameter and said mixing device is between 6 to 15 feet in length.

6. A mobile mixing device for the preparation of cementitious materials to contain and encapsulate hazardous wastes comprising a mobile element mounted on a trailer designed to be towed by a tractor, said mobile element comprising in order;

a. a driving device for transporting, mixing, metering and conveying;

b. a tank holding water;

c. a tank holding an aqueous solution of a silicate;

d. a tank holding an aqueous solution of a gelling agent;

e. a tank holding an aqueous solution of a plasticizer;

f. a tank holding an aqueous solution of a water proofing agent;

g. a bin holding a mixture of hazardous wastes containing sand, gravel or aggregate therein;

h. a bin containing cementitious material; wherein said bin g. and h. are positioned over a transporting means and said transporting means is connected to a mixing means, whereby when said hazardous waste and said cementitious material are transported from bins g. and h., aqueous material from tanks b. through g. are metered into said hazardous waste and said cementitious material at said mixing means, and said mixing means mixes said hazardous waste, said cementitious material and said aqueous material together with a residence time of between 5 and 45 seconds therein.

7. The mobile mixing device of claim 6 wherein said mixing means is an auger contained within a tube, said tube having a diameter of between 4 to 18 inches and said tube is held at an angle of between 22 and 60 degrees relative to the ground and said auger is rotated at a speed of between 300 and 800 revolutions per minute.

* * * * *